United States Patent [19]

Sudmeier

[11] 4,141,570

[45] Feb. 27, 1979

[54] ADJUSTABLE CONNECTION BETWEEN SKI AND BINDING

[76] Inventor: James L. Sudmeier, 1456 Everton Pl., Riverside, Calif. 92507

[21] Appl. No.: 842,728

[22] Filed: Oct. 17, 1977

[51] Int. Cl.[2] ..... A63C 9/00

[52] U.S. Cl. ..... 280/607; 280/618; 280/633

[58] Field of Search ..... 280/617, 618, 607, 633

[56] References Cited

U.S. PATENT DOCUMENTS

| | | | |
|---|---|---|---|
| 3,797,839 | 3/1974 | Smolka | 280/617 |
| 3,797,844 | 3/1974 | Smolka | 280/617 |
| 3,802,714 | 4/1974 | Freegard | 280/618 X |
| 3,917,298 | 11/1975 | Haff | 280/607 |
| 4,027,896 | 6/1977 | Frachin et al. | 280/618 |

*Primary Examiner*—Joseph F. Peters, Jr.
*Assistant Examiner*—Gene A. Church
*Attorney, Agent, or Firm*—Herbert E. Kidder

[57] ABSTRACT

An adjustable connection between a ski and its binding, comprising an elevated platform that is attached to the ski at two longitudinally spaced points by supports that allow the ski to flex between the supports. Mounted on top of the elevated platform is a boot plate, to which the ski binding is attached. The boot plate is attached to the platform by screw connections that allow for rotation of the boot plate about a vertical axis, or for translation in the fore-and-aft or lateral directions. The supports, in one form of the invention, are individually adjustable in length so that the platform can be tilted laterally with respect to the top surface of the ski, or tilted longitudinally, or raised and lowered while maintaining parallelism with respect to the ski. Thus, the invention allows for rotational adjustment about any one or all 3 mutually perpendicular axes, as well as translational adjustment in all 3 planes, all without removing the ski bindings from the platform, or the platform from the ski. In another form of the invention, the canting adjustment (i.e., lateral tilting) is accomplished with wedges and translational adjustments are limited to fore-and-aft and to lateral movement. The boot plate is shiftable longitudinally with respect to the platform, and also laterally; and is rotatable about a vertical axis.

6 Claims, 11 Drawing Figures

FIG. 1.
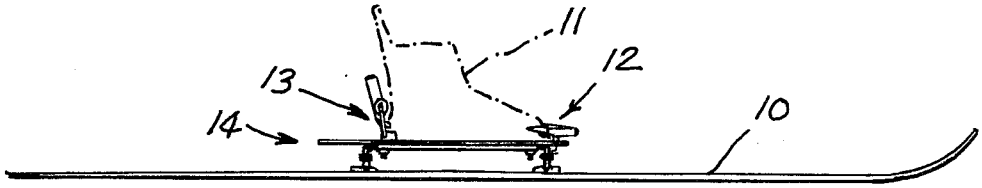
FIG. 2.
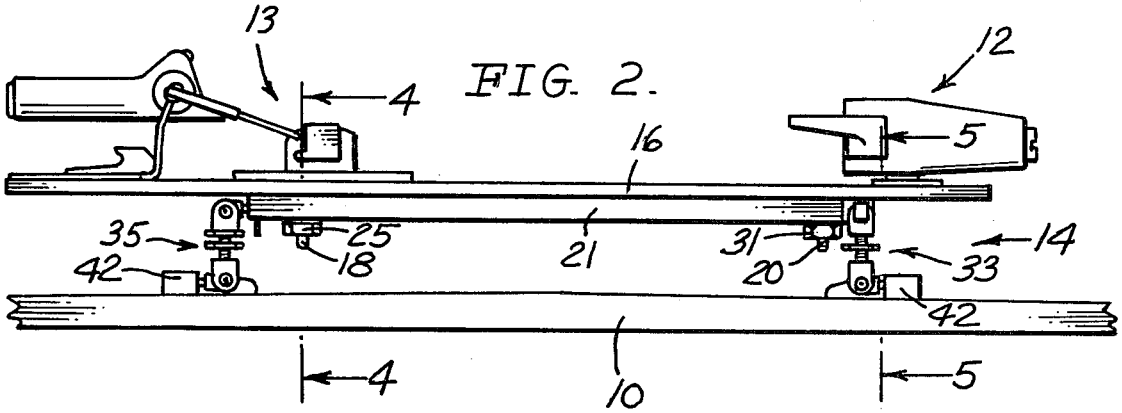
FIG. 3.
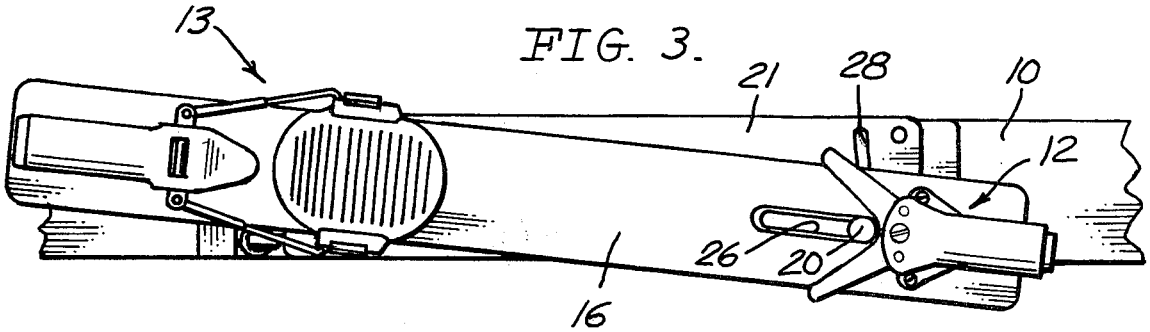
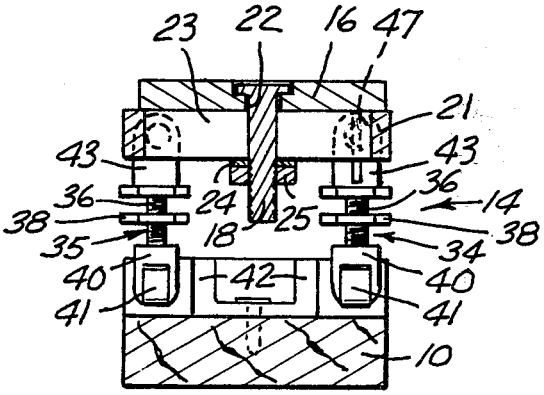
FIG. 4.
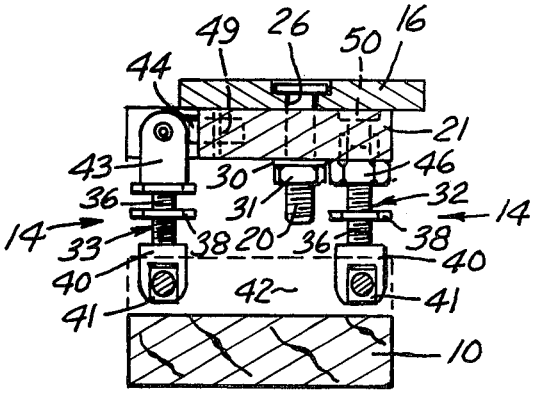
FIG. 5.

FIG. 7.
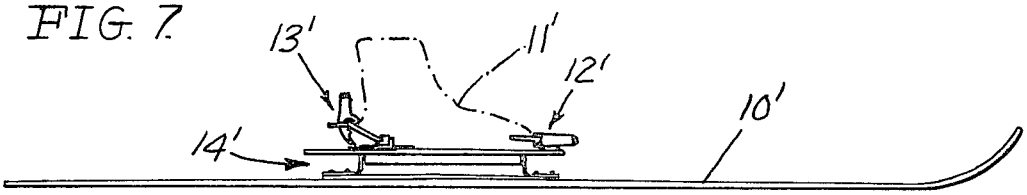
FIG. 8.
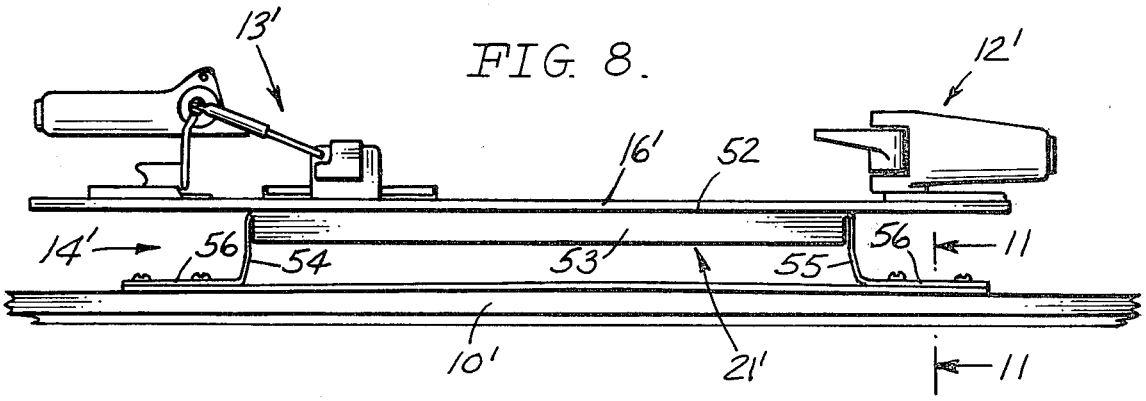
FIG. 9.
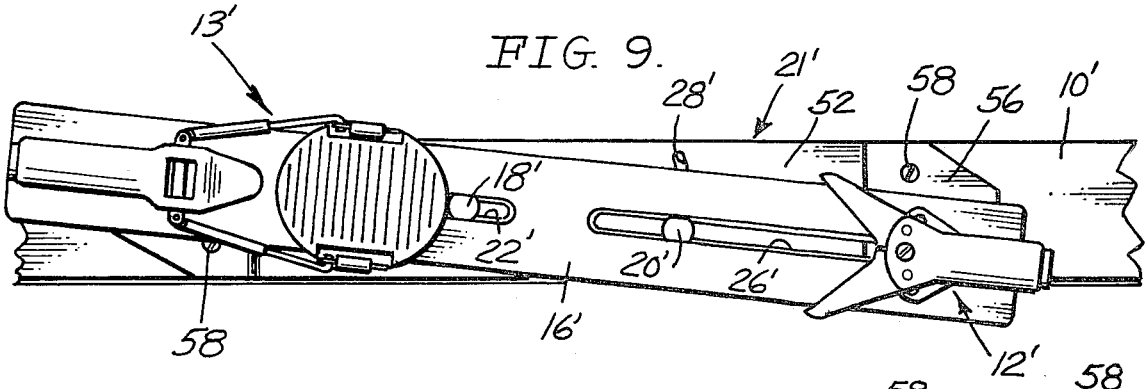
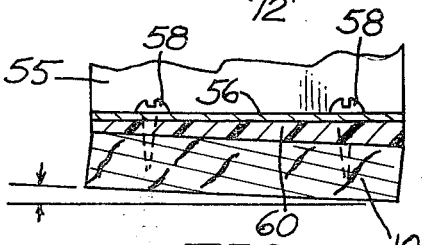
FIG. 11.
FIG. 10.
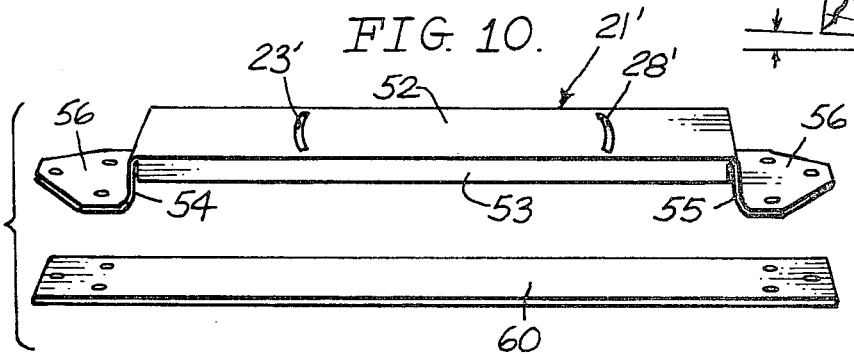

ADJUSTABLE CONNECTION BETWEEN SKI AND BINDING

BACKGROUND OF THE INVENTION

The present invention pertains generally to ski equipment, and more specifically to an adjustable connection between the bindings and the ski, whereby various modes of adjustability are provided between them, including translational and rotational movement.

Ideally, ski equipment should allow the skier to be in a balanced position over skis which ride flat on the surface of the snow under all conditions. Because of variations in anatomical configuration among various individuals, this ideal is seldom achieved, using standard boots, bindings and skis. For example, it is now generally accepted that a bow-legged skier achieves better performance by "canting" or placement of wedges under the bindings, which serve to raise the inside edge of each boot an equal amount along the entire length of the boot to compensate for the inclination of the foot sole caused by bow-leggedness.

Another anatomical variation of equal importance, for which there has been, up to now, no feasible method of correction, is the angular displacement of the foot with respect to the plane of the bent leg. That is to say, with many skiers there is a certain amount of toe-in or toe-out angularity, which would result in non-parallel skis if not compensated for. To correct this condition, the skier tends to force the plane of his bent leg to one side or the other of a plane defined by the longitudinal axis of the ski and the skier's center of gravity. However, when the knee is not directly over the axis of the ski, any forward bending at the ankle produces "edging" of the ski, which means that one edge of the ski digs into the snow. Authorities maintain that even a minor degree of edging will make a marked difference in the performance of a skier, particularly in racing. Warren Witherell, director of Burke Mountain Alpine Training Center in East Burke, Vermont, says in his book "How The Racers Ski": "a simple change of 1 degree in wedge need (required by boot break-in) has put these racers back in the winner's circle. That 1-degree difference, particularly if the skier is too much on his inside edges, can be worth more than two or three seconds per race." While Witherell was referring particularly to the use of wedges, the problem is exactly the same, whether produced by simple wedge needs or the toe-in, toe-out problem. For example, with a 10-degree toe-in or toe-out error, it can be shown by trigonometric calculation that an edging error of 3.4 degrees is produced by plus-or-minus 10 degrees flex at the ankle, and for 15 degrees toe-in or toe-out error, the corresponding edging variation is 5.1 degrees.

It is well-known among skiers that longitudinal placement of the bindings on the skis is extremely important for maximum performance. This can vary with the snow conditions, steepness of the terrain, type of skiing (i.e., downhill or slalom racing), and other factors. Thus, it may be desirable to shift the bindings further forward or aft of a given position for a special situation, but this is normally not feasible because it would involve drilling additional holes in the ski, which tends to be damaging to the skis.

Still another condition that may seriously affect a skier's performance is where one leg is shorter than the other. In this case, accommodation requires that the boot sole of the shorter leg be raised slightly higher above the ski than the boot sole of the longer leg.

Heretofore, efforts to provide different adjustments of the bindings with respect to the skis, both angular and translational, have required that the bindings be disassembled from the ski and then reassembled, usually necessitating the drilling of new holes in the ski, which is objectionable because it weakens the ski at a critical point and provides openings through which moisture can get into the interior of the ski. Moreover, many of the screws used to secure bindings to the skis are locked and sealed in place with epoxy cement, making them extremely difficult to remove. This type of adjustment has a number of serious disadvantages. For one thing, the problem of disassembling and reassembling the bindings precludes any possibility of making the adjustments on the ski slope if the skier should find that more or less angular or translational adjustment is required to correct for his particular anatomical condition. Another disadvantage is that some prior arrangements to provide for angular or rotational adjustments require that new holes be drilled in the ski for each adjustment, which means that if the initial adjustment is not completely satisfactory, a new set of holes will have to be drilled in the ski. Another shortcoming of prior efforts has been that only one, or at the most two, adjustments can be made, whereas it is frequently necessary that as many as 4 or 5 adjustments may be required to compensate for a particular anatomical configuration.

SUMMARY OF THE INVENTION

The primary object of the present invention is to provide an adjustable connection between the ski bindings and the associated ski which provides for rotational adjustment about all 3 mutually perpendicular axes, as well as translation in all three planes, in order to compensate for different geometrical errors of the skeletal structure of the leg, e.g. tibial torsion, so that the skier is enabled to retain his skis flat on the surface of the snow in straight running, while flexing his knees and ankles. One outstanding advantage of the invention is that all of the above-mentioned adjustments are made without disassembling the binding or even without removing the boot. Thus, the adjustments can be made on the ski slope if the skier feels that he needs just a little more correction in one way or the other. Another important advantage is that the several adjustments can be made without making additional screw holes in the ski, which would have a deleterious effect on the ski.

Another object of the invention is to provide an adjustable connection between the ski and its bindings which allows the skier to shift the position of the bindings along the chord length of the ski to place his center of gravity at its most advantageous position over the skis for the particular type of skiing contemplated. Thus, for example, the ski binding may be adjusted to place the toe of the boot 1 cm. ahead of the chord length center for slalom skiing; or directly on the chord length center for giant slalom skiing; or 1 cm. behind the chord length center for downhill skiing. "Chord length" is the straight-line measurement from the tail of a ski to its tip.

A further object of the invention is to provide an adjustable connection between the ski and binding, as described above, which does not seriously impede flexing of the ski.

These objects are accomplished by mounting the ski binding on an elevated platform, attached to the ski at two longitudinally spaced points by flexible attachments that allow the ski to bend under the binding. A further advantage of this arrangement is that the safe operation of the binding is unaffected by the flexing of the ski.

According to the present invention, the ski binding is mounted on a platform which is elevated a short distance above the ski. The ski bindings are attached to a plate, which is adjustable angularly about the vertical axis, and also slidable longitudinally along the chord length and laterally of the ski. In one form of the invention, the elevated platform can be canted to either side, or rocked slightly about a transverse axis; while in a second form of the invention, canting of the ski binding plate is accomplished by means of wedges.

The foregoing and other objects and advantages of the present invention will become apparent to those skilled in the art from the following detailed description of the preferred embodiments thereof, with reference to the accompanying drawings.

BRIEF DESCRIPTION OF THE DRAWINGS

FIG. 1 is a side elevational view of a ski with an adjustable connection between the ski and the binding, according to one form of the invention;

FIG. 2 is an enlarged side elevational view of the center portion of the ski, showing the adjustable connection and ski binding in more detail;

FIG. 3 is a top plan view of the structure shown in FIG. 2;

FIG. 4 is an enlarged transverse sectional view, taken at 4—4 in FIG. 2;

FIG. 5 is an enlarged transverse sectional view, taken at 5—5 in FIG. 2.

FIG. 7 is a view similar to FIG. 1, showing another embodiment of the invention;

FIG. 8 is an enlarged side elevational view of the center section of the ski and adjustable connection between the ski and binding of FIG. 7;

FIG. 9 is a top plan view of the section shown in FIG. 8;

FIG. 10 is an exploded view of the platform and wedge; and

FIG. 11 is an enlarged transverse sectional view taken at 11—11 in FIG. 8.

DESCRIPTION OF THE PREFERRED EMBODIMENTS

Figure 6:
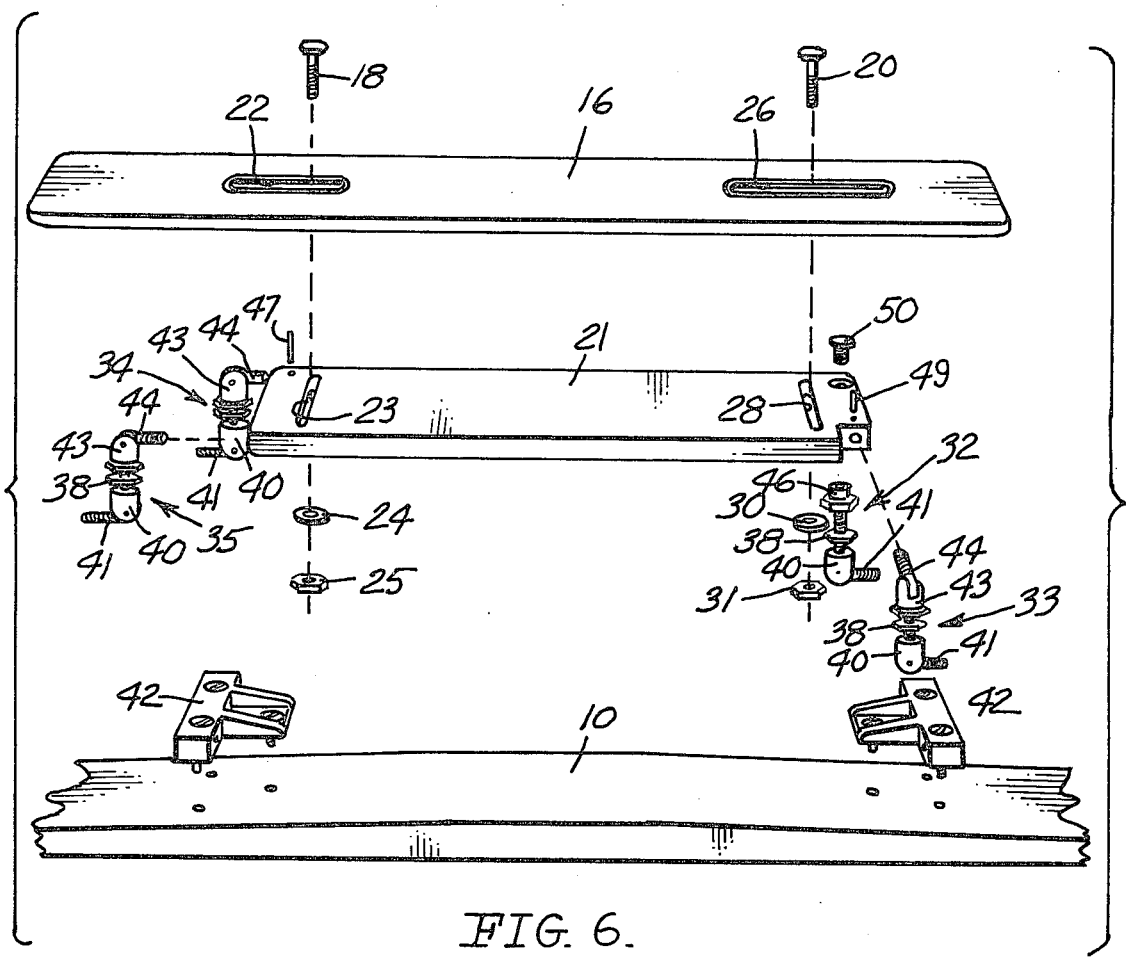
FIG. 6 is an exploded view of the adjustable connection, in which the ski binding has been omitted from the top plate, for clarity.

The embodiment of the invention shown in FIGS. 1–6, inclusive, will be described first, and attention is therefore directed to those figures. The reference numeral 10 designates a ski; 11 is the boot; 12 is a toe binding; and 13 is the heel binding. The adjustable connection of the invention is designated in its entirety by the reference numeral 14, and comprises an elongated, flat, rectangular boot plate 16, to which the toe binding and heel binding are attached. The boot plate 16 is attached by screws 18 and 20 to an elevated platform 21, also in the form of an elongated rectangle, which forms a part of the adjustable connection 14. Screw 18 passes through a longitudinal slot 22 in the boot plate 16, and through a transverse slot 23 in platform 21. On the bottom end of the screw is a washer 24 and nut 25. The longitudinal slot 22 in boot plate 16 has a shallow recess along both sides thereof, to receive the head of screw 18, so that the top surface of the screw head is flush with the top surface of the plate 16, or very slightly below the latter.

Screw 20 likewise passes through a longitudinal slot 26 in the boot plate 16, which also has a shallow recess along each side to receive the head of the screw. Below the boot plate 16, screw 20 passes through a transverse slot 28 in the platform 21 (see FIGS. 3 and 6) and is secured by a washer 30 and nut 31, which bear against the underside of platform 21.

Supporting the platform 21, at the four corners thereof, are adjustable legs 32, 33, 34 and 35. Each of these legs had a turnbuckle screw 36 with left-hand thread at one end and right-hand thread at the other, and a hexagonal head 38 at the middle, which is engageable by a wrench for turning the screw. The bottom ends of all four turnbuckle screws are screwed into internally threaded sockets in the top ends of clevises 40. Each of the clevises 40 has two laterally spaced arms that straddle and are pivotally connected by a pin to a member 41 having a threaded stem that is screwed into a socket in a base plate 42. The base plate 42 is attached to the top surface of the ski by screws, as best shown in FIG. 6. The threaded stems of members 41 extend parallel to the longitudinal axis of the ski, and the stems are free to turn in their sockets so as to allow the members 41 to pivot about their respective fore-and-aft axes.

The top ends of three of the screws 33, 34, 35, are likewise screwed into internally threaded sockets in the bottom ends of clevises 43, which are pivotally connected to members 44 having threaded stems that are screwed into sockets in the end portions of platform 21. The threaded stems of the two members 44 at the rear end of the platform extend forwardly, parallel to the longitudinal axis of the ski, while the threaded stem of member 44 on the front right-hand corner of the platform has its axis extending transversely of the ski. The left rear member 44 is prevented from turning in its socket by a pin 46, which extends through aligned holes in the platform 21 and stem of member 44, so that the left rear leg of the platform is maintained at a 90° angle to the platform, whereas the right rear leg is capable of pivoting on the threaded stem of member 44.

The turnbuckle screw 32 of the front left leg has its upper end screwed into a nut 46 which extends up through a hole 48 in platform member 41 and is secured by another screw 50. This arrangement also maintains the front left leg rigidly at a 90° angle to the platform 21, for reasons that will be explained presently.

In fitting the present apparatus to the skier's foot, the first step is to determine as nearly as possible the amount of rotation to be corrected. This may be by visual inspection or by any suitable angle-measuring system. Once the angle of rotation is known, platform 16 can be turned in the appropriate direction through the same angular distance, as shown in FIG. 3, by loosening nuts 25 and 31 on their respective screws 18 and 20 and then shifting the platform to the desired position, after which the nuts are retightened. The skis will now be parallel, even though the skier's feet may toe-out or toe-in.

If the skier is bowlegged, the bottom of the skis will not lie flat on the snow, but will tend to dig in at their outer edges. To correct this, the platform 21 can be tilted by turning the turnbuckle screws on either the inside adjustable legs to extend the same, or on the outside adjustable legs to shorten them. When the platform 21 has been tilted with respect to the skis at the same angle that the sole of the foot is canted with respect to the ground, the bottom of the ski will lie flat on the snow, even though the sole of the slier's foot is inclined due to his bowleggedness. The opposite correction will be made for a knock-kneed skier who tends to dig in the inner edge of his skis due to the inclination of the bottom of his boot.

If the skier wishes to move the ski bindings and boot forwardly or rearwardly from a given position, all that is necessary is to loosen the nuts 25 and 31 enough to allow boot plate 16 to slide over the elevated platform 21, and after the appropriate longitudinal adjustment has been made, the nuts are again tightened up.

Lateral translation of the boot plate 16 can also be accomplished by loosening screws 18 and 20 and shifting the plate laterally in the desired direction, while screws 18, 20 slide along their respective transverse slots 23', 28'.

The purpose of locking the two upper members 44 on the front left and rear left sides of platform 21 is to stabilize the platform and prevent it from rocking sidewise on its pivots. By maintaining one of the angles at 90°, the other angles can be increased or decreased to change the lateral slope of the platform 21 and the platform will remain rigid with respect to the ski after it has been adjusted.

Another, somewhat simpler form of the invention is shown in FIGS. 7–11, to which attention is now directed. In these drawings, parts that are essentially the same as in the first embodiment have been given the same reference numerals, with the prime (') suffix. In this case the elevated platform 21' may be made of sheet metal (preferably stainless steel) which is shaped to an elongated rectangular configuration, with a flat top surface 52 with downturned side edges 53 to stiffen it, and legs 54 and 55 that terminate in flanges 56 which lie flat against the top surface of the ski and are secured thereto by screws 58.

The boot plate 16' is connected to the platform 21' by two screws 18' and 20' which pass through longitudinal slots 22', and through transverse slots 23', 28', that may be straight, or arcuate, as desired. Thus, the boot plate 16' can be shifted longitudinally by sliding the plate over the platform after screws 18', 20' have been loosened, and then retightened. Rotational adjustment is accomplished by loosening screws 18' and 20', and then shifting one end of boot plate 16' to the left by sliding the corresponding screw 18', 20', to the left along its respective transverse slot 23', 28', while the other end of the boot plate is shifted to the right by sliding the corresponding screw to the right along its respective transverse slot. FIG. 9 shows the boot plate 16' rotated in the clockwise direction, about 5 degrees.

Lateral translation of the boot plate 16' can also be accomplished by loosening screws 18' and 20' and shifting the plate 16' laterally in the desired direction, while the screws 18', 20' slide along their respective transverse slots 23', 28'.

To correct for "canting" error, a wedge 60 may be interposed between the mounting flanges 56 of the platform 21' and the top surface of the ski, where it is secured in place by screws 58, or the wedge 60 may be attached to the underside of the boot plate 16', where it provides the angular correction between the boot plate and the platform. The use of wedges to correct "canting" error is well known in the art, and is shown here merely to illustrate how this may be done with the adjustable connection 14' of the present invention.

While I have shown and described in considerable detail what I believe to be the preferred forms of my invention, it will be understood by those skilled in the art that the invention is not limited to these details, but may take various other forms within the scope of the claims.

What I claim is:

1. An adjustable connection for use between ski bindings and a ski, comprising:

an elevated platform adapted to be mounted on the ski;

a boot plate to which the ski bindings are attached, said boot plate being mounted on top of said platform and being angularly adjustable with respect thereto in a substantially horizontal plane to compensate for toe-in or toe-out angularity of the foot and thereby position the skis parallel to one another despite the angularity of the skier's feet;

said boot plate being also adjustable longitudinally with respect to the length of the ski by sliding the boot plate forwardly or rearwardly on said platform so as to position the skier's weight at the optimum location along the length of the skis for the type of skiing being done or for conditions of the ski slope; and means for securing said boot plate in adjusted position.

2. An adjustable connection as set forth in claim 1, wherein means is provided for adjusting the transverse inclination of the boot plate with respect to the ski.

3. An adjustable connection as set forth in claim 1, wherein said elevated platform is connected at its front end to said ski by a pair of laterally spaced legs that are adjustable in length, and at its rear end by a second pair of laterally spaced legs that are adjustable in length, so as to allow for adjusting the transverse inclination of the boot plate with respect to the ski by lengthening or shortening the legs on one side of the boot plate to compensate for canting of the skis caused by bow legs or knock knees.

4. An adjustable connection as in claim 1, wherein said boot plate is rotationally adjustable with respect to the ski about 3 mutually perpendicular axes, and is translationally adjustable in 3 mutually perpendicular planes.

5. An adjustable connection as in claim 1, wherein said boot plate is rotationally adjustable with respect to said elevated platform about a perpendicular axis, and is translationally adjustable with respect to the platform in the direction parallel to the lengthwise axis of the ski and also laterally with respect thereto.

6. An adjustable connection as in claim 5, wherein said boot plate is attached to said platform by two longitudinally spaced screws which pass through elongated slots in the boot plate and in the platform, the slots in said boot plate extending in one direction with respect to the lengthwise axis of the ski, and the slots in said platform extending generally perpendicular to the slots in the boot plate.

* * * * *